US009751725B2

(12) United States Patent
Hall et al.

(10) Patent No.: US 9,751,725 B2
(45) Date of Patent: Sep. 5, 2017

(54) STAIRLIFT

(75) Inventors: David Hall, Staffordshire (GB); Jonathan David Handley, West Midlands (GB)

(73) Assignee: Handicare Accessibility Limited, West Midlands (GB)

( * ) Notice: Subject to any disclaimer, the term of this patent is extended or adjusted under 35 U.S.C. 154(b) by 532 days.

(21) Appl. No.: 13/878,559

(22) PCT Filed: Oct. 21, 2011

(86) PCT No.: PCT/GB2011/001515

§ 371 (c)(1),
(2), (4) Date: Sep. 11, 2013

(87) PCT Pub. No.: WO2012/052725

PCT Pub. Date: Apr. 26, 2012

(65) Prior Publication Data

US 2014/0151157 A1 Jun. 5, 2014

(30) Foreign Application Priority Data

Oct. 21, 2010 (GB) ..... 1017760.8

(51) Int. Cl.
*B66B 9/08* (2006.01)

(52) U.S. Cl.
CPC ..... *B66B 9/0838* (2013.01); *B66B 9/08* (2013.01); *B66B 9/0807* (2013.01); *B66B 9/0853* (2013.01); *B66B 2009/0876* (2013.01)

(58) Field of Classification Search
CPC ..... B66B 9/08; B66B 9/0838; B66B 9/0853
USPC ..... 187/201
See application file for complete search history.

(56) References Cited

U.S. PATENT DOCUMENTS 2,856,027 A 10/1958 Schryver
5,222,439 A 6/1993 Di Rosa
5,533,594 A * 7/1996 Tremblay ..... B66B 9/0838 187/201

(Continued)

FOREIGN PATENT DOCUMENTS

DE 196 51 747 6/1998
EP 0 488 475 6/1992

(Continued)

OTHER PUBLICATIONS

PCT/GB2011/001515WrittenOpinio, Jun. 4, 2012, Handicare Accessibility Ltd.

(Continued)

*Primary Examiner* — Michael Riegelman
(74) *Attorney, Agent, or Firm* — Wells St. John P.S.

(57) ABSTRACT

A stairlift (12) comprises a carriage (10) moveable along a rail (14) by a drive means (18) and a seat (34) moveably coupled to the carriage. Levelling means are provided for altering the orientation of the seat with respect to the carriage. Further, limiting means (40) are provided for limiting movement of the seat with respect to the carriage so as not to exceed a predetermined angle of inclination of the seat, and comprising locking means (42). When the angle of inclination of the seat reaches the predetermined angle, the limiting means mechanically engages with the seat assembly to prevent further movement of the seat and operates the locking means to secure the seat in position.

22 Claims, 18 Drawing Sheets

(56) References Cited

U.S. PATENT DOCUMENTS

| | | | | |
|---|---|---|---|---|
| 5,720,364 | A | 2/1998 | Glover | |
| 6,666,147 | B1 | 12/2003 | Minges | |
| 7,568,555 | B2 | 8/2009 | Vroegindeweij et al. | |
| 7,650,843 | B2 | 1/2010 | Minges | |
| 8,087,495 | B2 * | 1/2012 | Szentistvany | B66B 9/0815 187/201 |
| 2002/0011383 | A1 * | 1/2002 | Grass | B66B 9/0853 187/201 |
| 2002/0074189 | A1 | 6/2002 | Hester et al. | |
| 2004/0168605 | A1 | 9/2004 | Minges | |
| 2004/0238286 | A1 | 12/2004 | Vroegindeweij et al. | |
| 2005/0279580 | A1 * | 12/2005 | Szentistvany | B66B 9/0838 187/201 |
| 2007/0056803 | A1 * | 3/2007 | Szentistvany | B66B 9/0853 187/201 |
| 2007/0235265 | A1 * | 10/2007 | Vroegindeweij | B66B 9/0838 187/201 |
| 2011/0000744 | A1 | 1/2011 | Smith et al. | |
| 2011/0024237 | A1 * | 2/2011 | Vroegindeweij | B66B 9/0838 187/201 |

FOREIGN PATENT DOCUMENTS

| | | |
|---|---|---|
| EP | 1 197 465 | 4/2002 |
| EP | 1 449 801 | 8/2004 |
| EP | 1 772 412 | 4/2007 |
| EP | 2 119 660 | 11/2009 |
| GB | 2 358 389 | 7/2001 |
| GB | 2 367 807 | 4/2002 |
| GB | 2 397 289 | 7/2004 |
| WO | WO 95/18763 | 7/1995 |
| WO | WO 02/22422 | 3/2002 |
| WO | WO 03/004399 | 1/2003 |
| WO | WO 2004/014773 | 2/2004 |
| WO | WO 2005/012152 | 2/2005 |
| WO | WO 2006/001694 | 1/2006 |
| WO | WO 2008/142372 | 11/2008 |
| WO | WO 2009/078704 | 6/2009 |

OTHER PUBLICATIONS

PCT/GB2011/00151 SearchReport, Jun. 4, 2012, Handicare Accessibility Ltd.

GB 1017760.8 Search Report, Apr. 20, 2011, Handicare Accessibility Ltd.

EP 16180089.1 Search Report, Nov. 25, 2016, Handicare Accessibility Ltd.

* cited by examiner

STAIRLIFT

CROSS REFERENCE TO RELATED APPLICATION

This application is a 35 U.S.C. §371 of and claims priority to PCT International Application No. PCT/GB2011/001515 which was filed on 21 Oct. 2011, and was published in English, and claims priority to GB Patent Application No. 1017760.8, which was filed on 21 Oct. 2010, the teachings of which are incorporated herein by reference.

The present invention relates to stairlifts, and in particular to improvements in self-levelling stairlifts.

Stairlifts (e.g. as shown in FIG. 1) provide transportation of a person (or a wheelchair or such like) up and down stairs, assisting people who find ascending and descending stairs difficult and in particular those with limited mobility. Typically, a rail is mounted to or near a flight of stairs and a chair (or platform e.g. for a wheelchair) is mounted via a carriage on the rail. The carriage can be controlled by the user via a control means to travel along the rail and up and down the stairs. The rail may be straight or curved, depending on the configuration of the staircase up and down which the stairlift is required to travel. The gradient of the rail may also change along the length thereof.

It will be appreciated that it is important for the chair to remain substantially level at all times. Whilst specific action to level the chair will not normally be required when the rail is straight—i.e. where there are no bends or changes in gradient—levelling will otherwise be required.

Self-levelling arrangements are known where the entire profile of the rail is mapped and stored in an electronic memory. As the stairlift traverses the rail, its position along the length of the rail is monitored, and levelling corrections are applied as necessary based on the stored information and the calculated change in angle required in order to restore the chair to a level position. A downside of such arrangements is the need to map the entire rail profile in advance, which will differ for each installation.

Other systems are known wherein the angular position of the chair is continually monitored e.g. using angle sensors and, in the event of a deviation of the former from the latter, a suitable correction is applied to the chair orientation to restore the level thereof. A disadvantage of this approach is the onus of continually monitoring the level of the chair, and the consequential power and processing requirements.

Furthermore, should the self-levelling system fail—i.e. if the seat tips beyond a predetermined angle, the safety of the stairlift user may be put at risk.

The present invention has thus been devised with the foregoing in mind.

According to a first aspect of the present invention, there is provided a stairlift comprising a carriage moveable along a rail by a drive means, a seat moveably coupled to the carriage, and levelling means for altering the orientation of the seat with respect to the carriage. Limiting means limit movement of the seat with respect to the carriage so as not to exceed a predetermined angle of inclination of the seat, and comprise locking means. When the angle of inclination of the seat reaches said predetermined angle of inclination, the limiting means mechanically engages with the seat assembly to prevent further movement of the seat and operates the locking means to secure the seat in position.

It is an advantage that, in the event of a failure of the self-levelling system, the seat will be prevented from tipping beyond a predetermined angle to ensure the safety of the stairlift user.

In accordance with a second aspect of the present invention, there is provided a stairlift comprising a carriage moveable along a rail by a drive means. A seat is moveably coupled to the carriage. A levelling means is provided for altering the orientation of the seat with respect to the carriage. An activating means is responsive to detection of a trigger position on the rail to activate the levelling means where there is a change of gradient of said rail.

Advantageously, the present invention provides a self-levelling stairlift that neither requires full advance mapping of the entire stairlift rail, nor continuous monitoring of the level of the seat. The levelling means therefore only need to be activated at certain points along the length of the rail, meaning that power consumption is minimised.

According to a third aspect of the invention, there is provided a method of installing a stairlift in an installation, the method comprising providing a rail having a first end and a second end, the rail being installed such that the second end is vertically higher than the first end, mounting a carriage on the rail at the first end, the carriage being moveable with respect to the rail, providing means for driving the carriage along the rail, driving the carriage along the rail from the first end to expose the first end, and mounting to the first end an additional rail member to extend the length thereof.

It is an advantage that the stairlift carriage can be mounted to the bottom of the rail, avoiding the need to transport the carriage to the top of the rail (e.g. at the top of a flight of stairs). Installation of the stairlift is thus made easier, quicker, and less labour intensive.

In accordance with a fourth aspect of the invention, there is provided a stairlift installation comprising a rail and a carriage moveable along the rail by a drive means, the carriage being supported on the rail by one or more rollers on a first side of the rail and one or more rollers on an opposite side of the rail, wherein the transverse size of the rail between the rollers varies along the length of the rail in order to maintain contact between the rollers and the rail.

Advantageously, good contact between the rollers and the rail can be maintained, irrespective of the trajectory of the rail (straight, curved, helical etc).

In accordance with a fifth aspect of the invention, a stairlift comprises a carriage moveable along a rail by a drive means, a seat supported on a seat chassis that is moveably mounted to the carriage, and means for altering the orientation of the seat with respect to the seat chassis or the orientation of the seat chassis with respect to the carriage to facilitate embarkation of and/or disembarkation from the seat.

Advantageously, boarding and dismounting the stairlift is made easier, especially for less able or mobile users.

It will be appreciated that the above described aspects and embodiments, in whole or in part, may be used in any combination.

Embodiments of the invention will now be described in detail with reference to the accompanying drawings in which.

Figure 7:
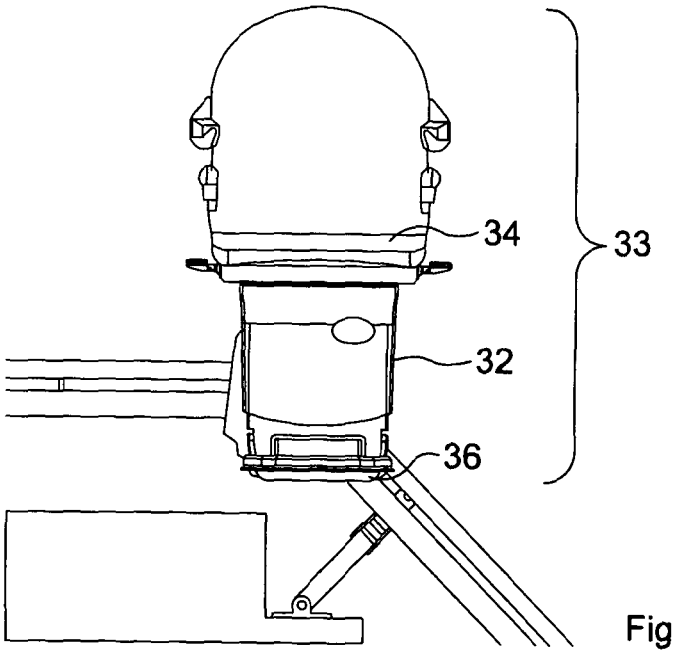
Figure 9A:
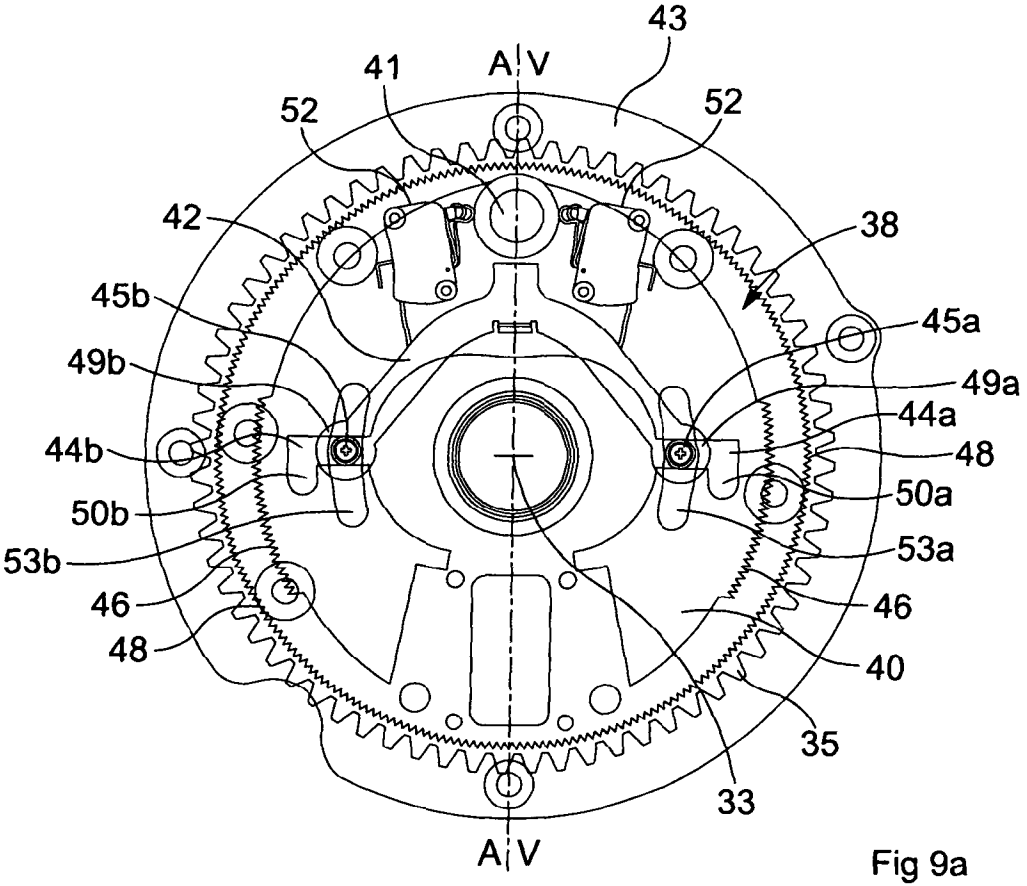
Figure 9B:
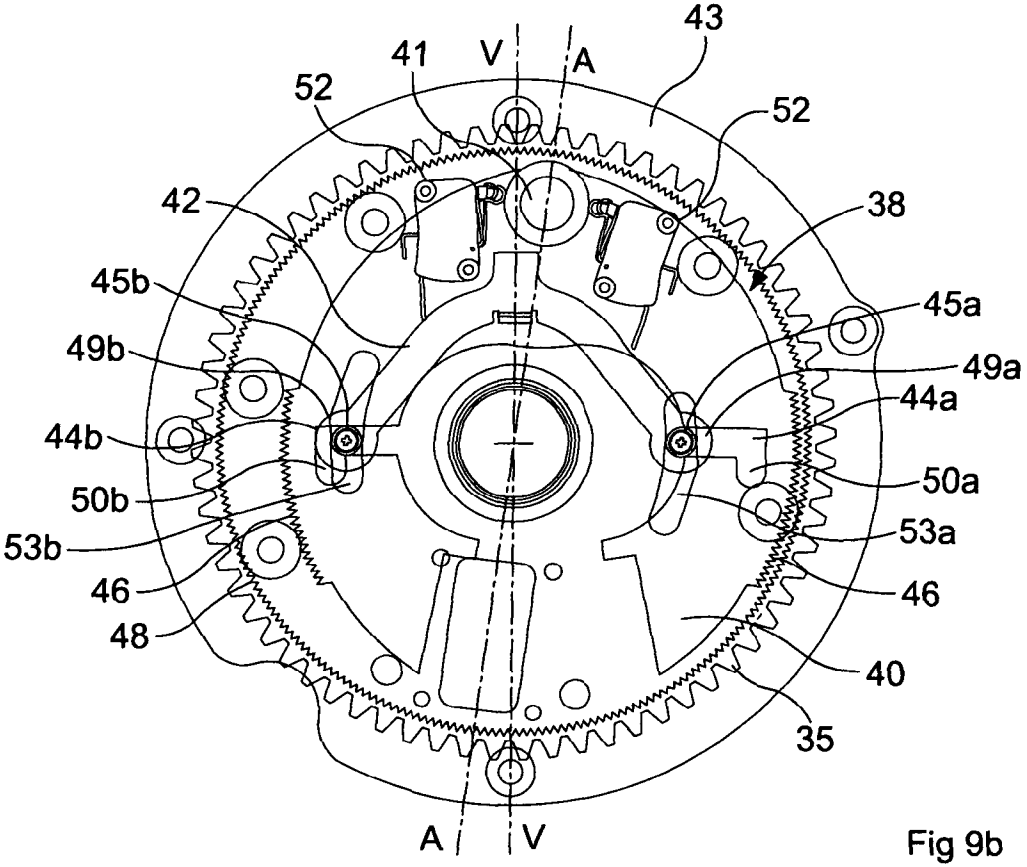
Figure 9C:
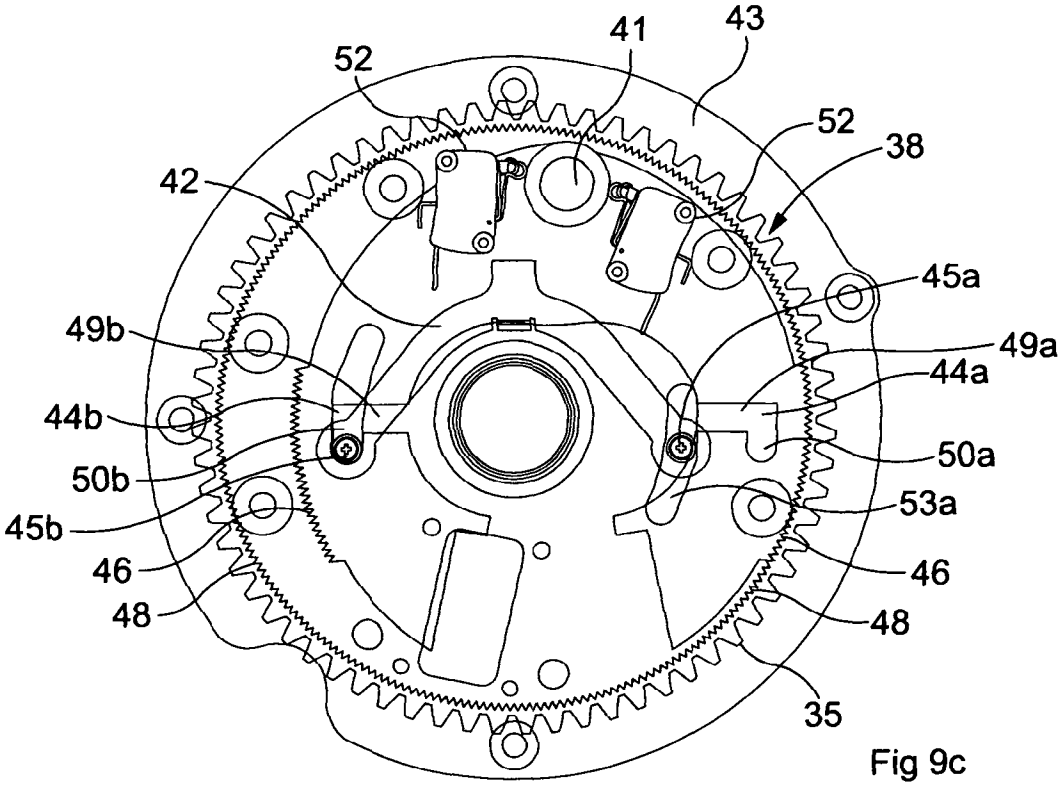
Figure 9D:
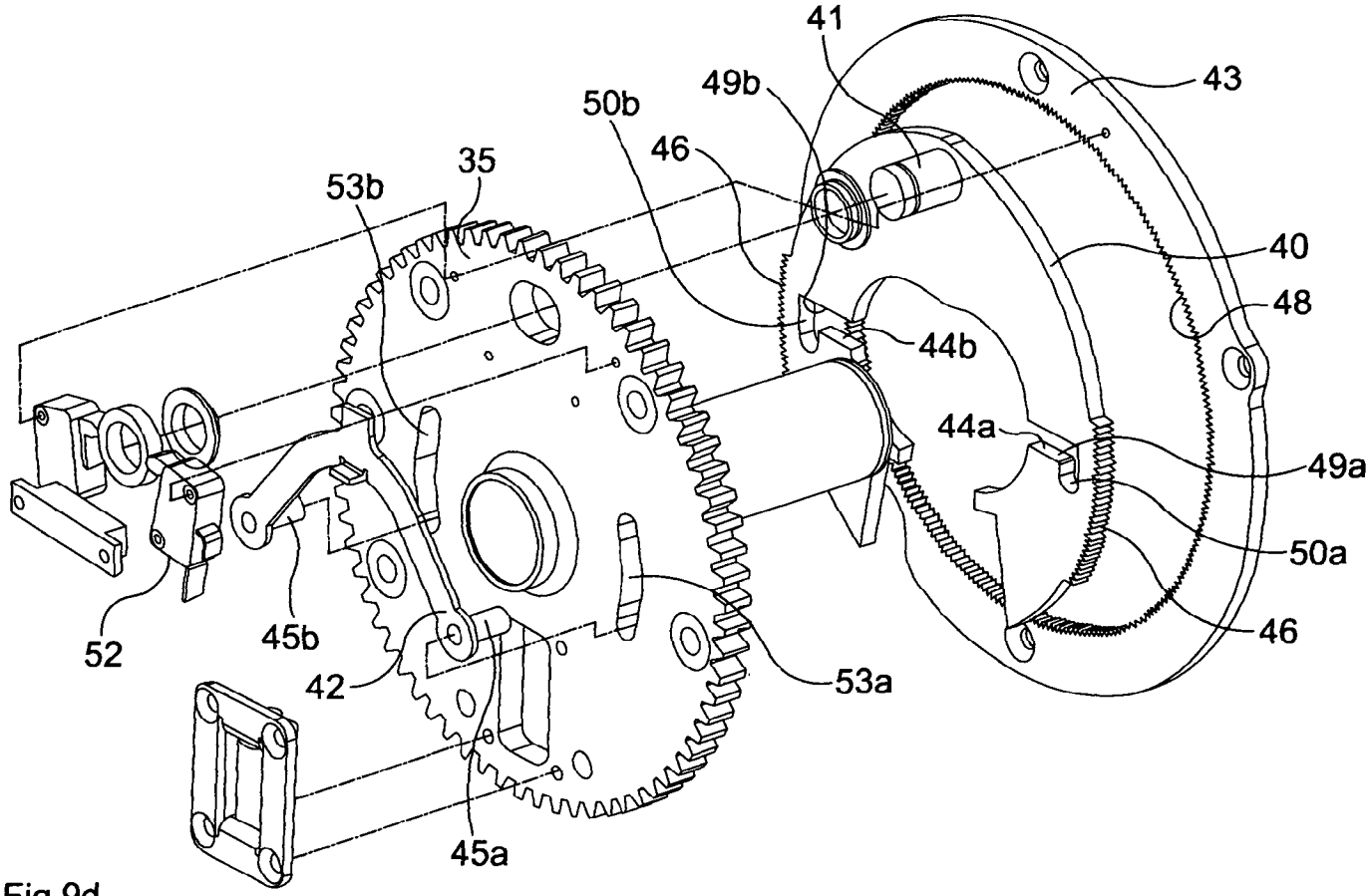

FIGS. 9*a*, 9*b* and 9*c* show an anti-tip arrangement incorporated in the seat chassis of FIG. 7;

FIG. 9*d* is an isometric "exploded" view of the arrangement of components making up the anti-tip arrangement of FIGS. 9*a*-9*c;*

Figure 9E:
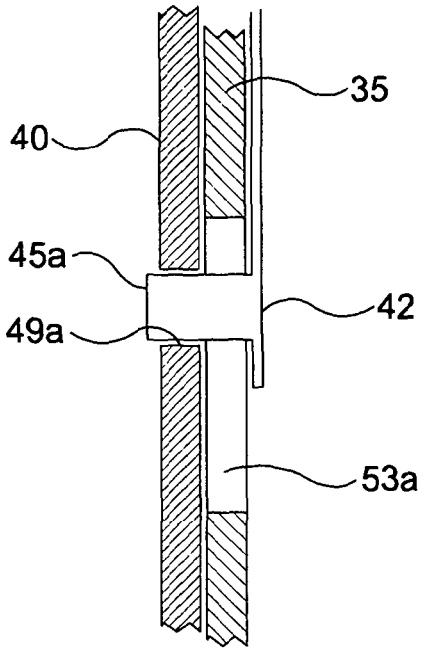

FIG. 9*e* is a cross-section through a part of the anti-tip device shown in FIG. 9*a.*

Figure 12:
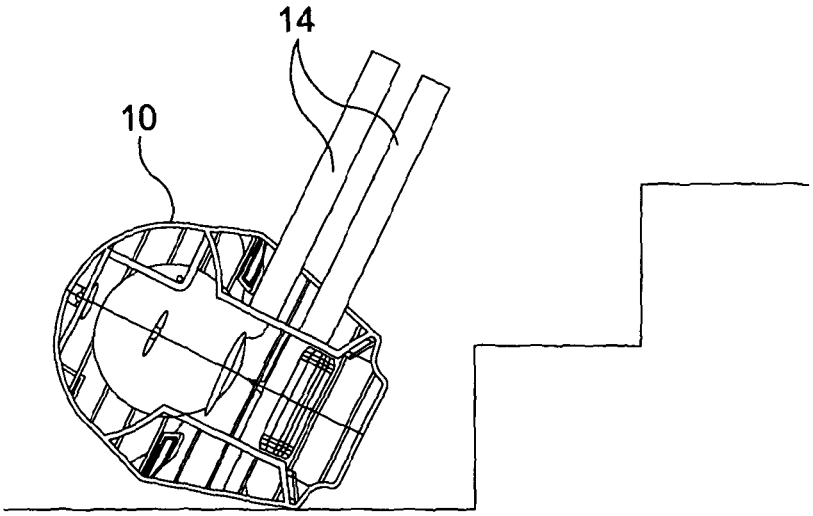
Figure 10:
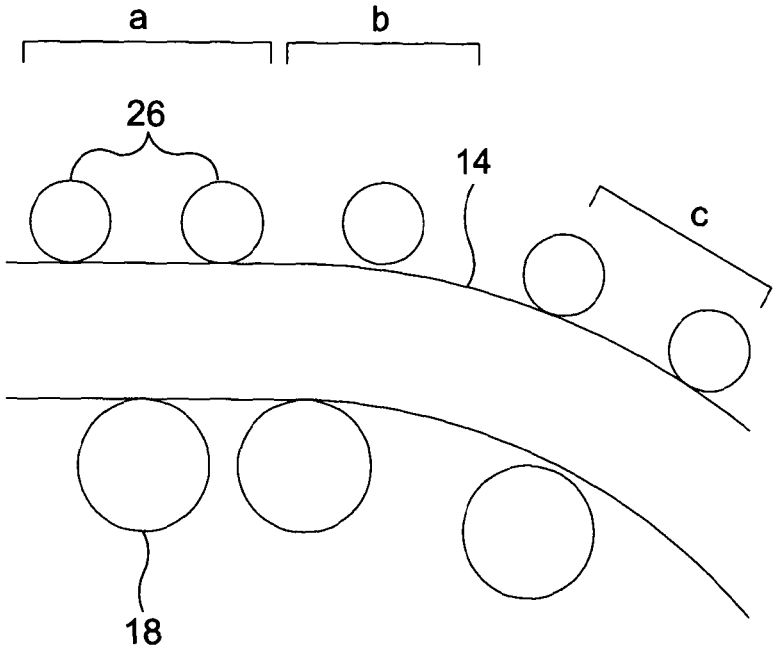
Figure 11:
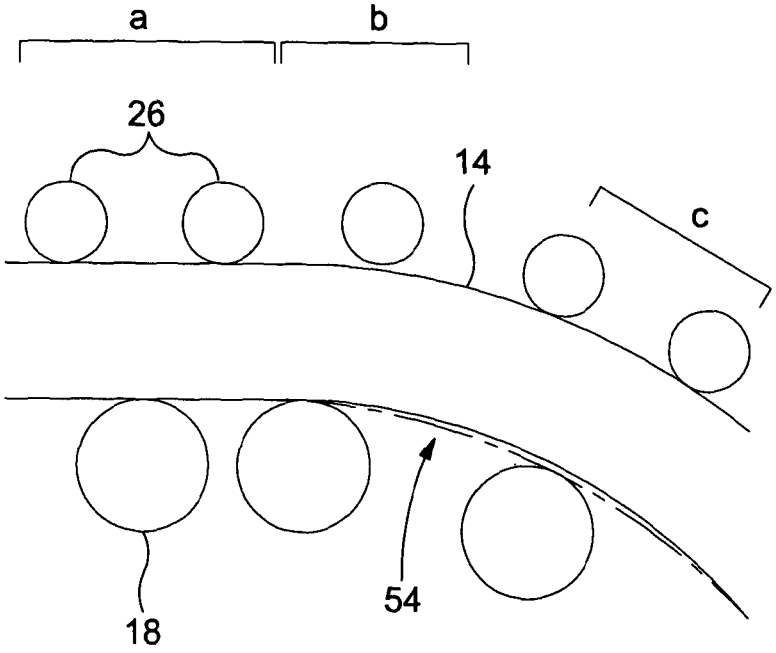
Figure 13:
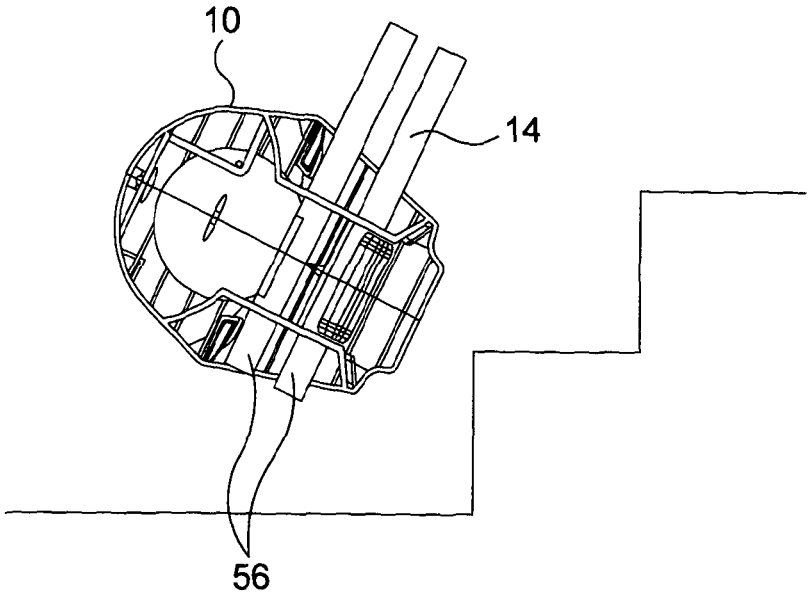
Figure 14:
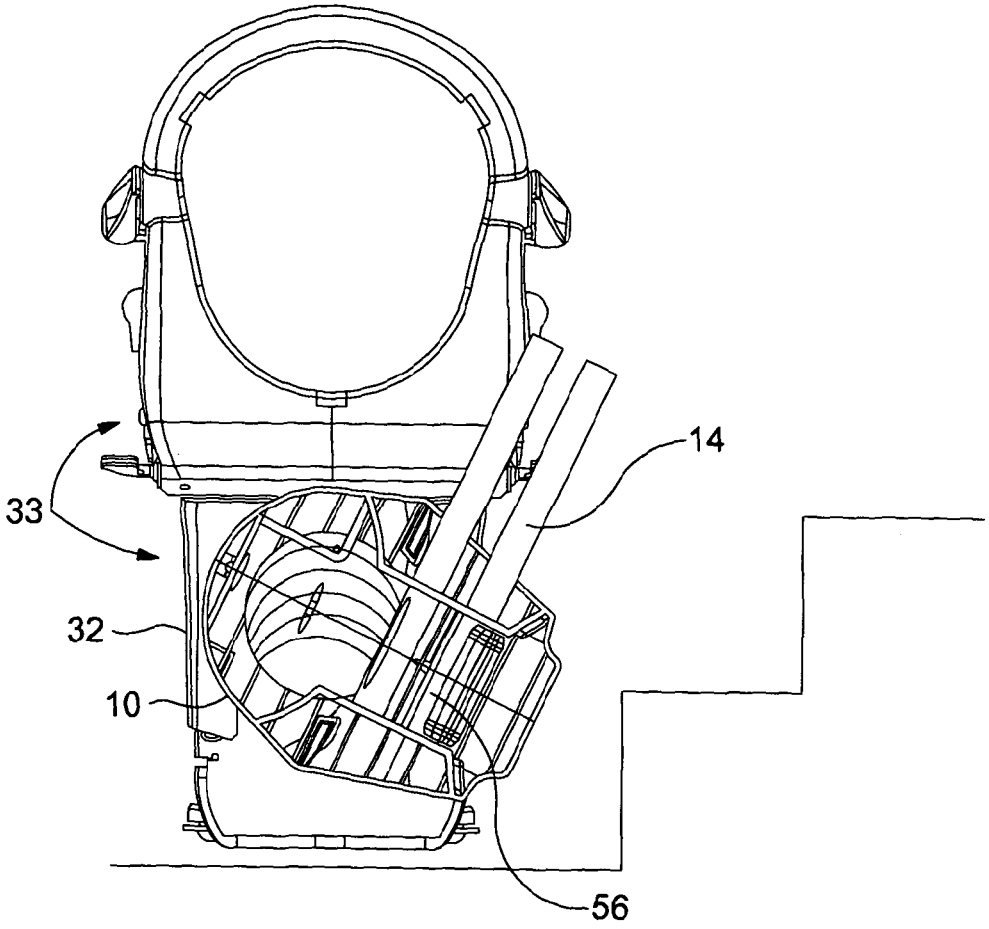
Figure 15A:
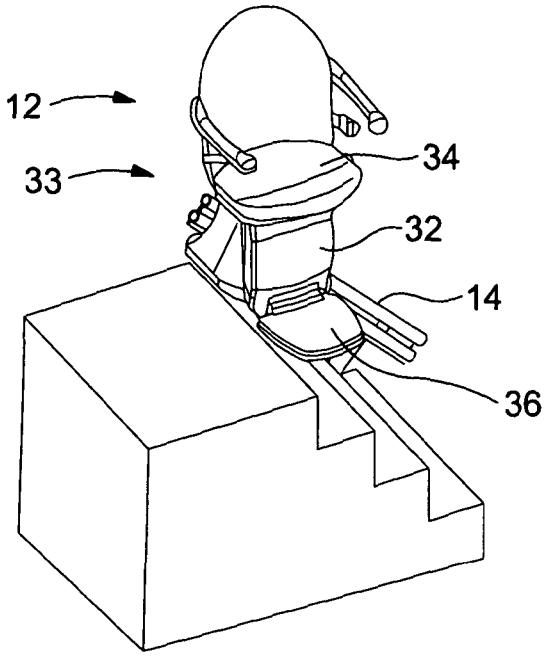
Figure 15B:
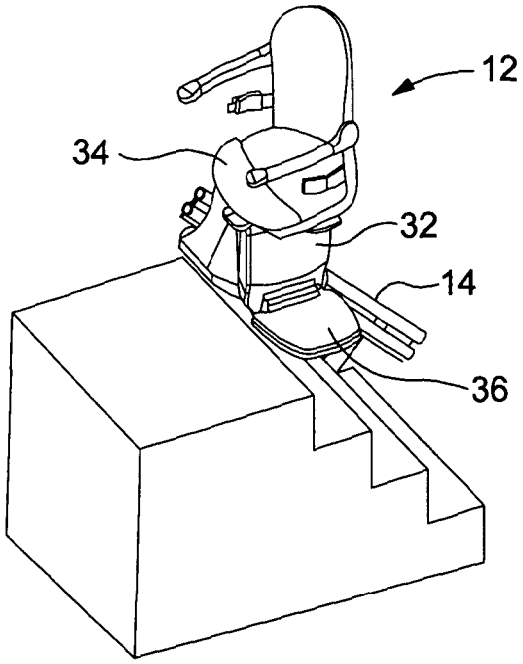
Figure 15C:
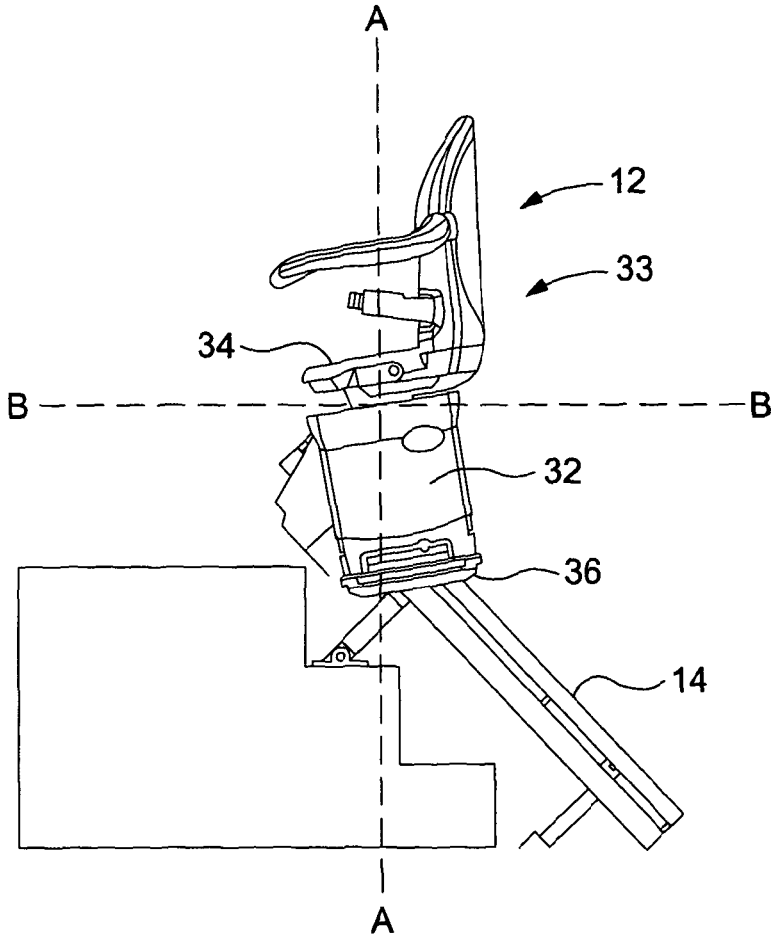

FIG. 10 shows rollers of the stairlift in relation to a rail in accordance with one embodiment of the invention;

FIG. 11 shows rollers of the stairlift in relation to a rail in accordance with another embodiment;

FIGS. 12 to 14 show a carriage of the stairlift according to a further embodiment of the invention; and FIGS. 15*a*, 15*b* and 15*c* show a stairlift according to a further embodiment.

Figure 2:
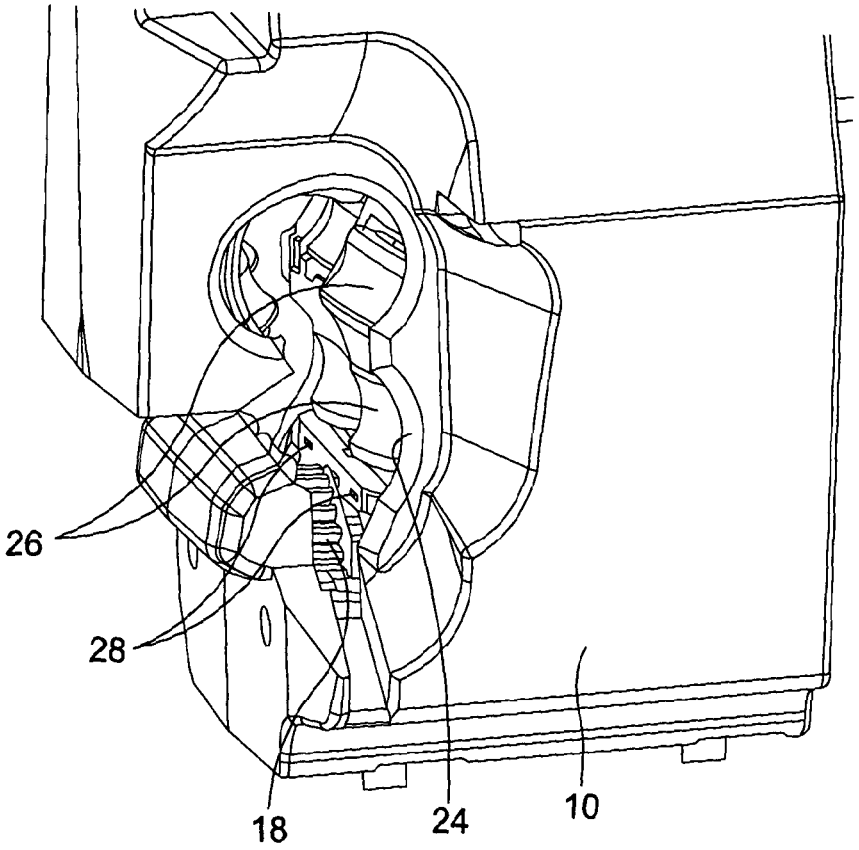
FIG. 2 shows a stairlift carriage in accordance with an embodiment.
Figure 3:
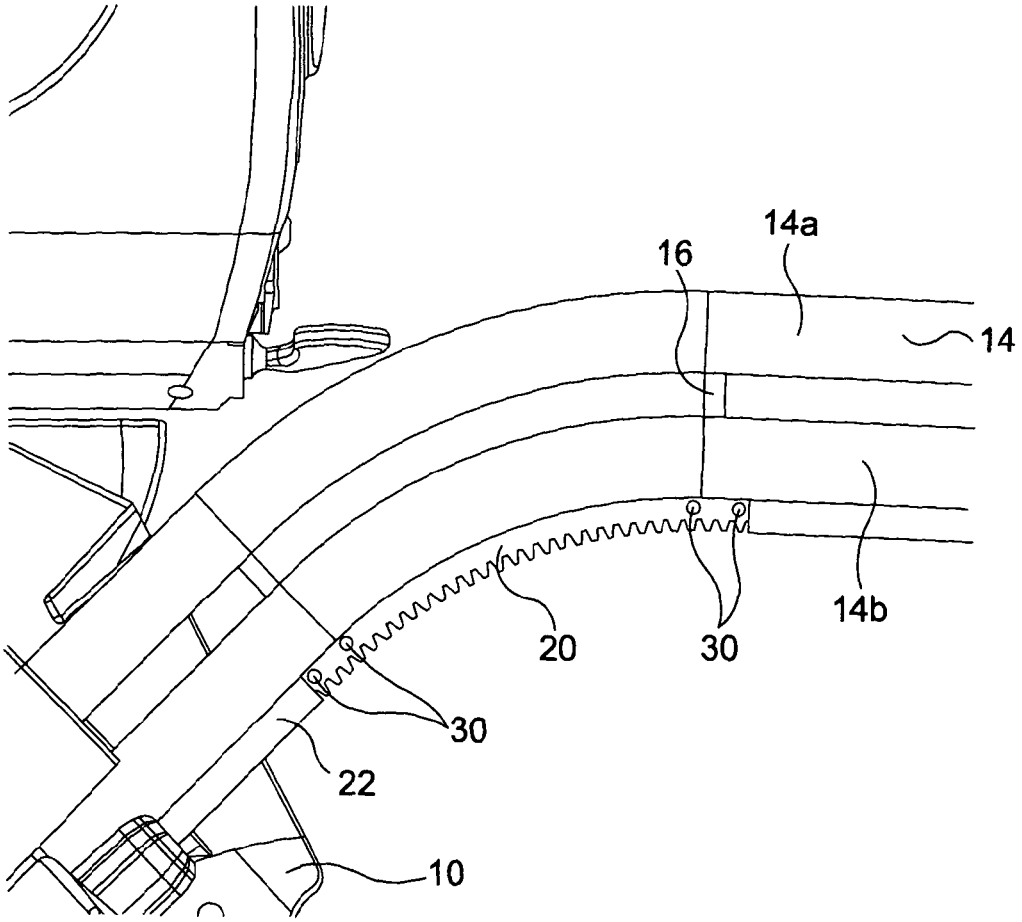
FIG. 3 shows the stairlift carriage of FIG. 1 in situ on a rail.
Figure 4:
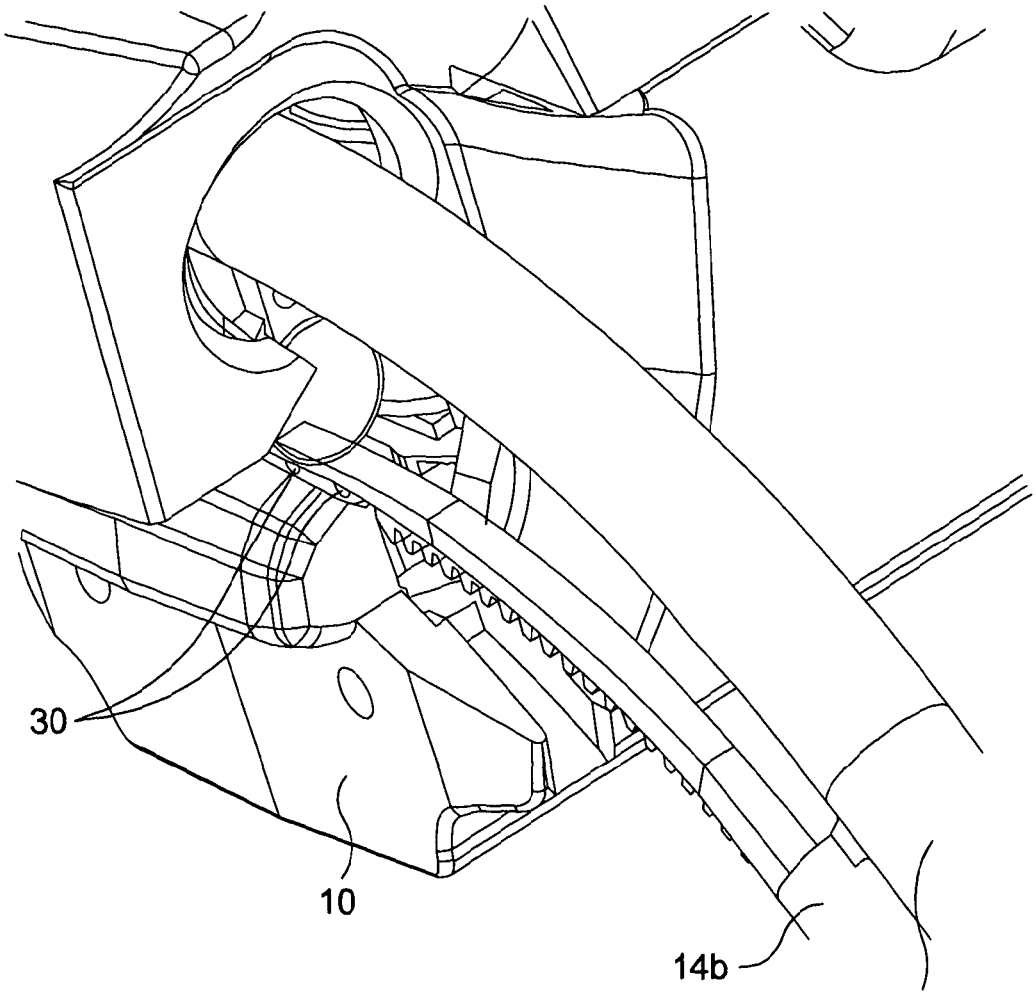
FIG. 4 shows the stairlift carriage of FIG. 1 or 2 where part of the rail is shown transparent for clarity.

Referring to FIGS. 2 and 3, a stairlift carriage 10 is provided. The carriage 10 forms part of a stairlift 12, not visible in its entirety in FIGS. 2 and 3, but shown e.g. in FIGS. 5 and 7. The carriage 10 is configured to be moveably mounted with respect to a rail 14. The rail 14 is typically mounted to a flight of stairs (e.g. as shown in FIG. 4), The rail 14 will guide the stairlift 12 along a predetermined path relative to the staircase. Boarding points for the stairlift are normally provided at the top and bottom of the stairs.

The rail 14 shown in FIG. 3 comprises two rail sections 14*a*, 14*b*, The rail sections 14*a*, 14*b* are coupled together with struts 16 along the length thereof. As such, the rail sections 14*a*, 14*b* act as a single rail, or "mono-rail" with a single drive in the carriage 10. This contrasts with known two-rail systems that have separate drives engaging separate racks on each rail. It will, however, be appreciated that a mono-rail system could have a plurality of individual rail sections, or indeed a single rail section. The carriage 10 comprises a drive gear 18 that engages with a toothed rack 20 that is attached to or forms part of the rail 14. The rack teeth are only shown in FIG. 3 at a section of the rail 14 where there is a change of gradient. However, the toothed rack actually extends along straight (constant gradient) sections 22 of the rail 14 as well. The drive gear 18 is driven by a motor or other drive means (not shown).

The carriage 10 is shaped to fit around the rail 14, and comprises a profiled aperture 24 to accommodate the rails. The stairlift 12 is supported on the rail 14 at the carriage 10 by means of rollers 26. It will be appreciated that the centre of gravity of the stairlift 12 and person or objects it carries is at some distance from the rail 14, thereby presenting a cantilevered load. The rollers 26 are arranged to provide support both for the dead weight of the load and reaction points supporting the cantilevered moment arm of the load.

One or more detectors or sensors 28 are provided within the carriage 10, operable for detecting or sensing a signal or other stimulus. The detectors 28 are preferably mounted at a position within the carriage 10 that will enable them to detect signals/stimuli from the rail 14 as the carriage 10 travels therealong. Trigger locations 30 are provided on or in the rail 14. A device capable of producing a signal or other stimulus detectable by the detectors 28 is provided at each of the trigger locations 30. In a preferred embodiment, magnets (not shown) are provided at the trigger locations 30, and the detectors 28 are or comprise magnetic detectors e.g. Hall effect sensors. The trigger devices are preferably provided at locations 30 where there is a change of gradient i.e. where the gradient of the rail 14 increases or decreases. In the embodiment shown there are four sensors, which are Hall effect sensors that detect the presence of magnets mounted to the rail 14. Two of the sensors detect magnets marking trigger locations of, respectively, the beginning and ending of a section of rail where the gradient is changing, when the stairlift is ascending. The other two sensors detect, respectively, corresponding trigger locations when the stairlift is descending. Different polarities (N/S) of the magnets may be used to indicate if the change of gradient is an increasing gradient or a decreasing gradient.

FIG. 4 shows the carriage 10 in position over a trigger location 30 (the lower rail section 14*b* is shown transparent for clarity). If the carriage 10 is traversing the rail 14 from left to right, it is at a transition point along the rail 14 where the gradient of the rail 14 begins to decrease.

Figure 5:
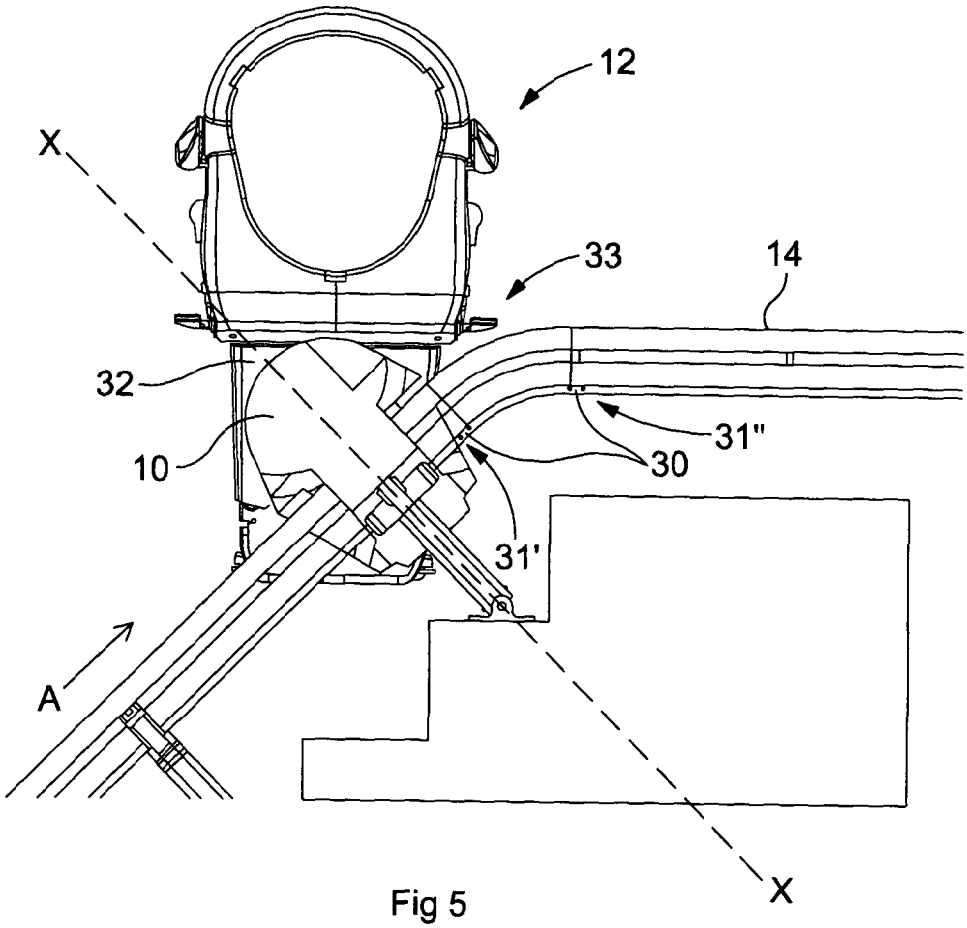
FIG. 5 shows a stairlift incorporating the stairlift carriage of FIGS. 1 and 2 approaching a gradient decrease in the rail.

FIG. 5 shows the stairlift 12 in a position along the rail 14. The stairlift 12 is moving in the direction of arrow A and is on a section of the rail 14 having a constant gradient. The stairlift 12 is approaching a section of rail 14 where there is a change of gradient. This section is between magnets 30 and between magnets 31' and 31", marking respective trigger points. The stairlift 12 further comprises a seat or chair assembly 33 including a seat or chair 34 (see FIG. 7) mounted on the carriage 10. The seat assembly 33 comprises a seat chassis 32, which is mounted to the carriage 10 through a coupling mechanism that permits some relative rotation so that the seat 34 can be maintained in a level, or upright position. In embodiments of the present application employing a mono-rail system 14, the axis X-X of the carriage 10 is always perpendicular to the rail. The seat chassis 32 is therefore rotated with respect to the carriage 10 to keep the seat 34 level with the horizontal as the stairlift 12 travels through the section of rail 14 where the gradient is changing.

In exemplary embodiments the rail 14 is designed so that at every change of gradient the rate of change of gradient is a constant. Thus, each time the stairlift 12 passes a trigger location 30 that indicates start of a gradient change, levelling is performed at a constant rate until the stairlift 12 reaches the trigger location 30 indicating the end of the gradient change. As mentioned above, the polarity (north or south) orientation of the magnets are used to distinguish between increasing and decreasing gradients when traversing upwards or downwards. For example, a north-facing magnet may be used to indicate a gradient increase and a south-facing magnet for a gradient decrease. If the lead hall effect sensor detects a first signal (say a south-facing magnet) indicating start of an increasing gradient when the stairlift is ascending, this will trigger the start of appropriate levelling correction (say clockwise correction of the seat 32 relative to the carriage 10). On the way down when the lead hall-effect sensor detects the south-facing magnet this indicates the start of a decreasing gradient so that anticlockwise levelling correction is applied.

A levelling system (not shown) is provided to rotate the seat chassis 32 relative to the carriage 10, to alter the angle of the seat 34. The levelling system comprises a levelling motor which is configured to be activated to level the seat 34 in response to a signal from a detector 28, when triggered due to passage by a magnet 30. An exemplary levelling arrangement will be described in more detail below, with reference to FIGS. 9*a*-9*c*. By comparison, a high proportion of known stairlift systems rely on systems where the seat chassis 32 does not rotate relative to the carriage 10. These may be fixed gradient systems, which are consequently limited in the range of installations where they can be used.

Other known systems include dual-rail systems employing a pair of carriages on an upper and a lower rail, with the vertical distance between the upper and lower rail maintained constant.

Figure 6:
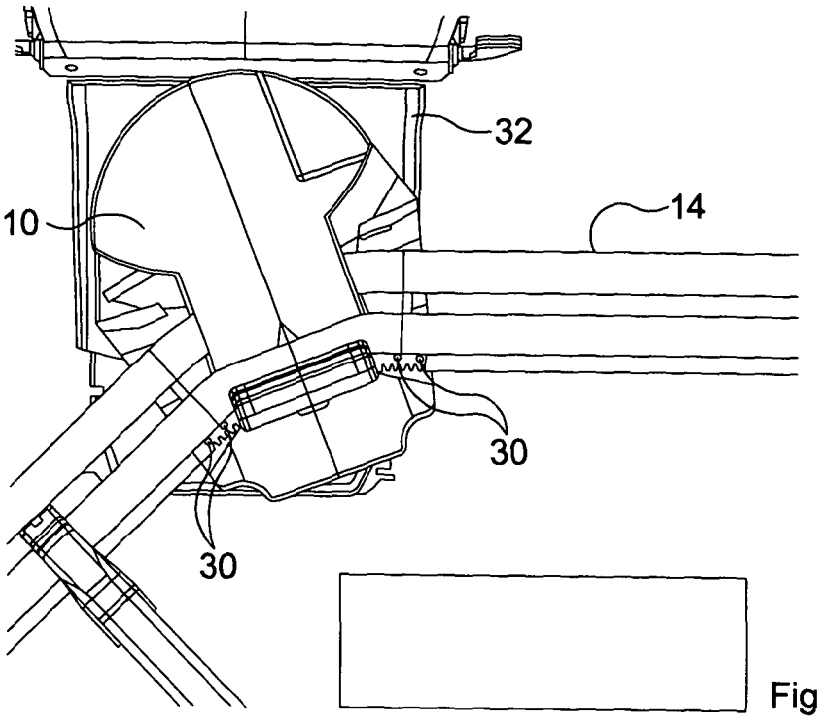
FIGS. 6 and 7 show rear and front views of the stairlift of FIG. 4 at a gradient change.

FIG. 6 shows an enlarged view of the carriage 10 of FIG. 5, but at a different location with respect to the rail 14. FIG. 7 shows a front view of the stairlift 12 at the position shown in FIG. 6.

The operation of the stairlift will now be described. Typically, a user will board the stairlift 12 at the top or bottom of the flight of stairs. At the boarding point, the seat chassis 32 is checked to ensure it is level with respect to the horizontal. Typically, the seat may include a sensor, such as a MEMS accelerometer, to measure the angle of inclination. In the event that the seat chassis 32 is not level, e.g. due to any errors that were introduced during the previous journey, a correction may be applied. Once the initial checks have been performed, and any necessary corrections made, a signal is sent to the drive means to operate the drive gear 18 to initiate movement of the stairlift 12 along the rail 14 away from the boarding location.

When the carriage 10 starts to move along the rail 14, the gradient of the rail 14 will initially be constant. Since the level of the seat 34 was checked prior to movement, there is no need to check the level again after movement has been initiated (and thus no need to apply a level correction) if the gradient of the rail 14 has not changed. Therefore, whether the stairlift 12 starts moving horizontally, or at a steady incline, no checks or corrections are required until there is a change in the gradient of the rail 14.

For example, the stairlift 10 shown in FIG. 5 is traversing the rail 14 in the direction indicated by arrow A. When the stairlift 12 reaches a location 31' where the gradient of the rail 14 changes, one or more magnetic markers 30 on the rail 14 will trigger a response in the detector(s) 28. The detector(s) 28 then send a signal to the levelling system to commence levelling of the seat 34. The levelling arrangement continues to operate during traverse of the gradient change. When the stairlift 12 reaches a location 31" where the change in gradient of the rail 14 ceases, i.e. the stairlift 12 is to travel along a length of rail 14 where the gradient is constant, a second magnetic marker 30 triggers a response at the detector 28 which, in turn, sends a signal to the levelling arrangement to cease levelling. Again, the next section of rail 14 may be horizontal or vertical, but since the gradient is constant no further levelling is required. Furthermore, helical rail bends can be traversed without levelling since, even though there is a change in the direction of the rail 14, there is no change in gradient.

Embodiments of the invention thus have the advantage that a constant rate of ascent/descent of the stairlift 12 will not trigger levelling. The arrangement described thus avoids the need to apply constant monitoring and levelling, and does not require full prior mapping of the rail 14 in order to be able to apply levelling corrections at the locations where it is required.

Figure 8:
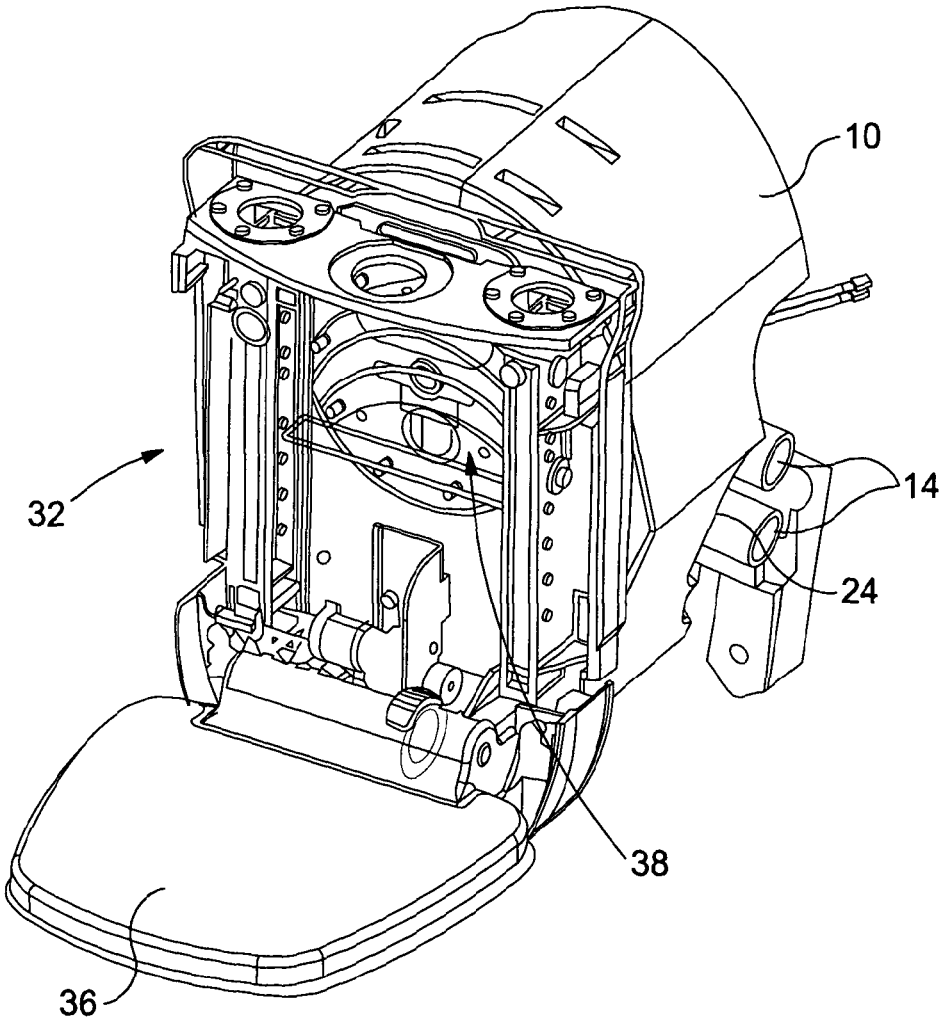
FIG. 8 shows a view of the seat chassis/footplate assembly and stairlift carriage in accordance with an embodiment of the invention.

Referring now to FIG. 8, the seat chassis 32 is shown mounted to the carriage 10. For clarity, the seat itself has been removed. A footplate 36 is mounted to the base of the seat chassis 32.

FIGS. 9*a*, to 9*d* show the levelling mechanism, together with a safety mechanism 38 in the seat chassis 32. The safety, or "anti-tip" mechanism 38 is operational in the event of a failure of the levelling mechanism. The levelling mechanism includes an outer toothed drive gear 35 which is driven, via a pinion gear and a servo-motor (not shown) in the carriage 10 to rotate the seat chassis 32 with respect to the carriage 10, about a centre of rotation 33.

As can be seen from FIGS. 9*a* to 9*d* the safety mechanism 38 comprises a pendulum 40 hanging from a pendulum bearing support 41 such that it is free to move with respect to the carriage 10 by rotating about the bearing support 41 under the force of gravity. Mounted to the chassis 32 behind the drive gear 35 (as shown in FIG. 9*d*) is an auxiliary ring 43. The pendulum 40 is symmetrically shaped with an approximately circular outer profile having formations 46, e.g. teeth, on an outer edge thereof. The formations 46 are engageable with complementary shaped formations 48 provided on the inner confines of the auxiliary ring 43, and thereby act as a means of limiting the inclination of the seat to a predetermined angle by preventing any further rotation of the drive gear 35.

In addition, means are provided to lock the seat in the limited inclined angle. The locking means includes a locking member 42 that is trapped by the pendulum 40 when at less than the predetermined angle, but which is freed to move so as to operate the locking means when relative rotation of the pendulum 40 reaches the predetermined angle of inclination. The configuration of the locking member 42 in this embodiment can be seen in the expanded view of FIG. 9*d*. The locking member 42 comprises a pressed sheet in the form of a wishbone which connects a pair of pins 45*a*, 45*b*. Radially inwardly of the outer profile, the pendulum 40 also comprises cut-outs or slots 44*a*, 44*b* that include substantially horizontal portions 49*a*, 49*b* extending outwardly into generally vertically-extending portions 50*a*, 50*b*.

The drive gear 35 has a pair of vertically oriented arcuate slots 53*a*, 53*b* spaced apart either side of the centre of rotation 33 so as to lie at a radius that corresponds to the location of the horizontal portions 49*a*, 49*b* of the slots 44*a*, 44*b* in the pendulum 40, but at a smaller radius than the vertically extending portions 50*a*, 50*b* of the slots 44*a*, 44*b*.

As shown in FIG. 9*a*, when the seat is in a level position, each of the pins 45*a*, 45*b*, of the locking member 42 rests within each of the horizontal portions 49*a*, 49*b* of the slots 44*a*, 44*b* in pendulum 40, and also extends through the arcuate slot in the drive gear 35. FIG. 9*e* shows a cross-section through a pin 45*a* of the locking member 42 and parts of the pendulum 40 and drive gear 35. The pin 45*a* is trapped (i.e. cannot move left, right, up or down) by the pendulum 40 and drive gear 35 at the location where the horizontal portion 49*a* of the slot 44*a* overlaps with the arcuate slot 53*a* in the drive gear 35.

FIGS. 9*a*, 9*b* and 9*c* show the safety mechanism 38 in three conditions. FIG. 9*a* shows the safety mechanism 38 in the "normal" operating position. That is, the stairlift 12 is either running along a rail 14 of constant gradient or the self-levelling system is functioning correctly at maintaining a level condition of the seat 34. Under these normal operating conditions, where the seat 34 is level perpendicular to the longitudinal axis A-A of the seat chassis, the pendulum 40 is oriented vertically along axis V-V. The pins 45*a*, 45*b* of the locking member 42 are resting within the horizontal portions 49*a*, 49*b* of the slots 44*a*, 44*b*, which lie substantially horizontally. In the event of minor deviations of the seat 34 away from a level condition, the pendulum 40 will move with respect to the seat chassis 32 and the positions of the pins 45*a*, 45*b* within the horizontal portions 49*a*, 49*b* of the slots 44*a*, 44*b* will alter slightly. If the seat 34 returns to a level condition, the seat chassis axis A-A will again coincide with the axis of the vertical V-V.

In the event of a failure of the self-levelling system e.g. when encountering a change of gradient of the rail 14, the axis A-A of the seat chassis 32 will move away from the vertical axis V-V, e.g. as shown in FIG. 9*b*. In this position, the pendulum 40 still hangs vertically due to gravity, but is no longer positioned symmetrically with respect to the vertical axis V-V, and has moved towards the auxiliary ring 43 on one side. In FIG. 9*b*, the pendulum 40 is shown tipped towards the right hand side (the pendulum is actually hanging vertically, but the seat/chassis 32 is leaning by a small angle). Due to the symmetrical configuration of the pendulum 40 itself, and its initial symmetrical positioning with respect to the carriage 10 and seat chassis 32, the relative position of the pendulum 40 can move in either direction responsive to changes in seat level in either direction. As can be seen, the teeth formations 46 on the pendulum 40 are close to engaging the corresponding teeth formation 48 on the auxiliary ring 43. However, the pins 45*a*, 45*b* of the locking member 42 resting in the horizontal portions 49*a*, 49*b* of the slots 44*a*, 44*b* are constrained by the arcuate slots 53*a*, 53*b* to remain in the same lateral position relative to the seat. In the position shown the pendulum 40 has shifted such that the pin 45*a* on the right hand side of FIG. 9*b* has almost reached the edge of the outermost end of the horizontal portion 49*a* of the slot 44*a*.

FIG. 9*c* shows the safety mechanism 38 in a non-level or "tipped" position, where the level of the seat 34 has reached a predetermined angle away from the horizontal. The predetermined angle may be, for example, approximately 10°. In this position the teeth 46 of the pendulum 40 engage or mesh with the corresponding teeth 48 on the auxiliary ring 43. The right hand pin 45*a* has reached past the end of the horizontal portion 49*a* of the slot 44*a*. The vertical portion 50*a* of the slot 44*a* now overlaps the arcuate slot 53*a* and so the pin 45*a* has dropped into the slot 53*a*. At the same time, the left-hand pin 45*b* has moved out of the horizontal portion 49*b* of the slot 44*b*, and it also has dropped into the arcuate slot 53*b*. In this position, the pendulum 40 is locked and cannot move relative to the auxiliary ring 43. As a result, the pendulum 40 cannot move back out of engagement with the auxiliary ring 43 and the seat chassis 32 is prevented from further rotation.

The dropping of the locking member 42 also ensures completion of the final extent of relative angular movement between the pendulum 40 and the auxiliary ring 43. At this point a limit switch device, e.g. a micro-switch 52, is activated to stop the drive means for the carriage 10, and to halt operation of the stairlift completely. As such, the engagement of the teeth 46, 48 defines the predetermined angle that will prevent the seat 34 rotating further, and the dropping of the locking member 42 locks or secures the seat 34 in position for safety.

The invention thus provides a two-stage securing mechanism—(i) the inter-engagement of the teeth 46, 48 serve to prevent further movement of the chair in the same direction in which tipping first occurred and (ii) the locking member 42 and slots 44*a*, 44*b*, 53*a*, 53*b* lock the seat in position so that it cannot then move at all (in either direction).

Turning now to FIG. 10, one configuration for the rollers 26 is shown. The drive configuration of the carriage 10 is designed to be able to withstand a full user load plus an overload condition, for safety reasons. In order to reduce the size of the carriage 10 required, multiple small rollers are desirable as these spread the load carrying capacity. In the embodiment shown, a pair of small rollers 26 are located above the rail 14, and a single larger roller the drive gear 18 is located therebelow. It will, however, be appreciated that other arrangements could be used.

Using multiple rollers can, however, give rise to a loss of control when negotiating gradient increases and decreases, for the following reason. Parts a, b and c of FIG. 10 represent the passage of the rollers 26, 18 along the rail 14 from left to right. The rail 14 shown has a transition from straight to curved, with a decreasing gradient. In position 'a', the rail 14 is straight and all rollers 26, 18 are in good contact with the rail 14. In position 'b', when transitioning from a straight rail 14 to a gradient change, the rollers 26, 18, and especially the upper right hand roller, lose contact with the rail 14.

In position 'c', during the gradient change, the lower roller 18 has lost contact with the rail 14. Such loss of contact could lead to loss of control of the stairlift 12 as it travels along the rail 14.

Therefore, although the use of two upper rollers 26 helps to carry and spread the load, their separation gives rise to a loss of control. One solution to this problem is to correct the gear pitch line, by moving it away from the rail so as to increase the transverse distance between the rail 14 and the lower roller 18 to ensure that good rail-roller contact is maintained at all times. FIG. 11 shows additional, corrective material 54 added to the rail 14. This additional material alters the pitch line of the rack underneath the rail so that the drive gear 18 is pushed away from the tubular rail 14 to increase the distance between the rail and the centre of the drive gear 18.

Figure 1:
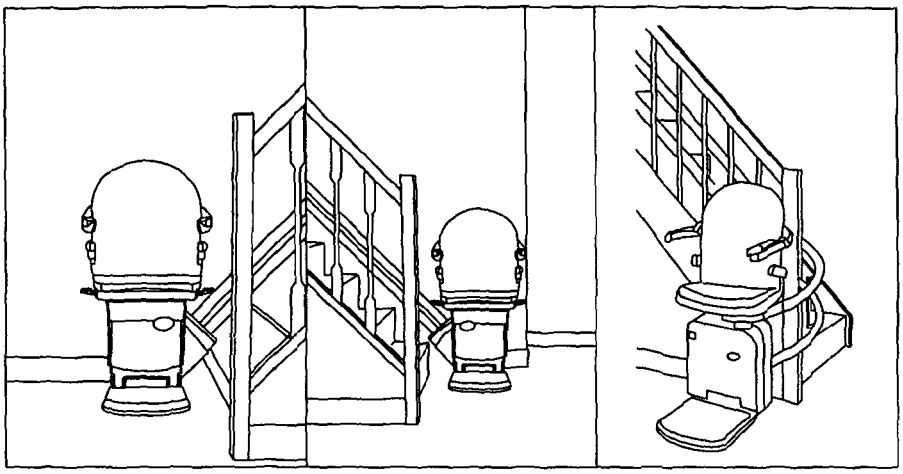
FIG. 1 shows examples of known stairlifts.

In conventional stairlifts, e.g. of the kind shown in FIG. 1, the installation first requires the rail 14 to be assembled to or near the staircase. As discussed above, boarding points are normally provided at the top and bottom of the stairs. In order to minimise the height of the lower boarding point, to minimise the step-up to the stairlift 12 for less able users, the end of the rail 14 and the footplate 36 are positioned as close to the ground or floor as possible. This can result, however, in the rail 14 or seat chassis 32 touching the floor, or the need to change the trajectory of the guide rail 14 at its lowest point to enable the lowest footplate 36 position. This has required the carriage 10 to be mounted on to the rail 14 at the top of the stairs because there is insufficient room at the bottom thereof for the aforementioned reason.

Referring to FIG. 12, the stairlift carriage 10 is shown, the carriage 10 being suitable for mounting to the bottom of the rail 14. This is advantageous because it avoids the need to carry the stairlift carriage 10 up the stairs to mount to the rail 14 at its top end. The carriage 10 is designed to be of minimum width, to facilitate mounting at the bottom of the rail 14. This also, advantageously, reduces the bulk of the machinery incorporated in the stairlift. In addition, however, the rail system 14 is designed to stop short of the floor level, to allow the installation and/or removal of the carriage 10. The carriage 10 is then driven up the rail 14, to allow the foot plate 36 and seat assembly 33 to be attached to the carriage 10. As shown in FIG. 13, rail end sections 56 are then added to the ends of the rail 14. The rail end sections 56 form end stops, and form part of the rail system used in guiding the roller assembly 26 of the carriage 10, but are not required for driving the stairlift 12.

The carriage 10 can then be driven down to its lowest position, as shown in FIG. 14. At this point, the footplate 36 and seat assembly 33 is fixed to the carriage 10, enabling the foot plate 36 to be at the lowest possible position for the user.

Referring to FIGS. 15*a*, 15*b* and 15*c*, the stairlift 12 is shown at the top boarding point of the stairs. When the stairlift 12 reaches the end of its journey, at the end of the rail 14, the user will be oriented in a direction facing away from the rails, as shown in FIG. 15*a*. The seat 34 is configured to rotate with respect to the seat assembly 33, to place the user in a direction parallel with the rail 14, to facilitate dismounting from or embarking onto the stairlift 12, as shown in FIG. 15*b*.

To further assist the user in embarking/disembarking the stairlift 12, the seat assembly 33 is further configured to tilt forward with respect to the vertical (A-A), such that the level of the seat 34 is tipped forward away from the horizontal axis B-B, as shown in FIG. 15*c*. This may be achieved by activating the servo motor of the seat levelling mechanism to drive the pinion gear 11 (see FIGS. 9*a*, 9*b* and 9*c*) and rotate the seat 34 relative to the carriage 10.

The invention claimed is:

1. A stairlift comprising:

a carriage moveable along a rail by a drive mechanism;

a seat assembly moveably coupled to the carriage;

a levelling mechanism operable in either of two opposing directions to alter the orientation of the seat assembly with respect to the carriage; and a limiting mechanism configured to limit movement of the seat assembly with respect to the carriage so as not to exceed a predetermined angle of inclination of the seat assembly, and comprising a locking mechanism;

wherein, when the angle of inclination of the seat assembly reaches said predetermined angle of inclination, the limiting mechanism mechanically engages with the seat assembly to prevent further alteration of the orientation of the seat assembly with respect to the carriage and operates the locking mechanism to lock the seat assembly in position at said predetermined angle of inclination and prevent movement of the seat assembly in either of said two directions at the same moment in time.

2. The stairlift of claim 1, wherein the limiting mechanism is pivotally or rotatably moveable with respect to the carriage or the seat assembly.

3. The stairlift of claim 2, wherein the limiting mechanism comprises a pendulum that is free to move with respect to the seat assembly until said predetermined angle is reached.

4. The stairlift of claim 3, wherein the pendulum comprises formations that are configured to interengage with correspondingly shaped formations provided on the seat assembly that includes a seat.

5. The stairlift of claim 4, wherein the interengaging formations comprise teeth.

6. The stairlift of claim 3, wherein the locking mechanism comprises a locking member trapped between said pendulum and said seat assembly when relative rotation of the pendulum with respect to the seat assembly is less than the predetermined angle of inclination, and wherein the locking member is freed to move so as to operate the locking mechanism when relative rotation of the pendulum with respect to the seat assembly reaches the predetermined angle of inclination.

7. The stairlift of claim 6 wherein the locking member comprises a pin received in a substantially horizontal slot in said pendulum and in a vertically oriented slot in a member affixed to the seat assembly, and wherein the horizontal slot extends into a substantially vertical slot into which the pin can drop when relative rotation of the pendulum with respect to the seat assembly reaches the predetermined angle of inclination.

8. The stairlift of claim 7 wherein the vertically oriented slot in the member affixed to the seat assembly and the substantially vertical slot in the pendulum are arranged such that when the pin drops further relative rotation between the pendulum and the seat assembly is prevented by the pin.

9. The stairlift of claim 1, further comprising a stopping device configured to stop movement of the carriage along the rail on engagement of the limiting mechanism with the seat assembly.

10. The stairlift of claim 9 wherein the stopping device comprises a limit switch activated by said limiting mechanism.

11. The stairlift of claim 1 wherein the limiting mechanism is adapted to limit movement of the seat assembly with respect to the carriage so as not to exceed the predetermined angle of inclination of the seat assembly in either of said two opposing directions.

12. The stairlift of claim 11 wherein the limiting mechanism is substantially symmetrical in each of the opposing directions.

13. The stairlift of claim 1 wherein the seat assembly comprises a seat chassis and an auxiliary ring which is mounted to the seat chassis, and the limiting mechanism engages the auxiliary ring when the angle of inclination of the seat assembly reaches the predetermined angle of inclination.

14. The stairlift of claim 13 wherein the limiting mechanism does not engage the auxiliary ring when the angle of inclination of the seat assembly is less than the predetermined angle of inclination.

15. The stairlift of claim 1 wherein the limiting mechanism is received within an auxiliary ring of the seat assembly and an outer surface of the limiting mechanism engages an interior surface of the auxiliary ring when the angle of inclination of the seat assembly reaches the predetermined angle of inclination.

16. The stairlift of claim 15 wherein the outer surface of the limiting mechanism has a plurality of formations which engage a plurality of correspondingly shaped formations on an interior surface of the auxiliary ring when the angle of inclination of the seat assembly reaches the predetermined angle of inclination.

17. The stairlift of claim 1 wherein the levelling mechanism comprises a drive gear which provides an axis of rotation of the seat assembly with respect to the carriage, and wherein the axis of rotation passes through the limiting mechanism.

18. The stairlift of claim 17 wherein the locking mechanism engages the drive gear and the limiting mechanism.

19. The stairlift of claim 1 wherein the limiting mechanism engages an auxiliary ring of the seat assembly to limit the movement of the seat assembly with respect to the carriage and the locking mechanism engages the limiting mechanism to prevent movement of the seat assembly in either of said two directions.

20. A stairlift comprising:

a carriage moveable along a rail by a drive mechanism;

a seat assembly moveably coupled to the carriage;

a levelling mechanism configured to alter the orientation of the seat assembly with respect to the carriage;

a limiting mechanism configured to limit movement of the seat assembly with respect to the carriage so as not to exceed a predetermined angle of inclination of the seat assembly, the limiting mechanism comprising a pendulum that is free to move with respect to the seat assembly until said predetermined angle is reached; and a locking member trapped between said pendulum and said seat assembly when relative rotation of the pendulum with respect to the seat assembly is less than the predetermined angle of inclination, and wherein the locking member is freed to move so as to lock the seat assembly in position at said predetermined angle of inclination to prevent rotational movement of the seat assembly with respect to the carriage when relative rotation of the pendulum with respect to the seat assembly reaches the predetermined angle of inclination;

wherein the locking member comprises a pin received in a substantially horizontal slot in said pendulum and in a vertically oriented slot in a member affixed to the seat assembly, and wherein the horizontal slot extends into a substantially vertical slot into which the pin can drop when relative rotation of the pendulum with respect to the seat assembly reaches the predetermined angle of inclination.

21. The stairlift of claim 20 wherein, when the angle of inclination of the seat assembly reaches said predetermined angle, the limiting mechanism mechanically engages with the seat assembly to prevent further alteration of the orientation of the seat assembly.

22. A stairlift comprising:

a carriage moveable along a rail by a drive mechanism;

a seat assembly moveably coupled to the carriage;

a levelling mechanism operable in either of two opposing directions to alter the orientation of the seat assembly with respect to the carriage; and a limiting mechanism configured to limit movement of the seat assembly with respect to the carriage so as not to exceed a predetermined angle of inclination of the seat assembly, and comprising a locking mechanism;

wherein, when the angle of inclination of the seat assembly reaches said predetermined angle of inclination, the limiting mechanism mechanically engages with the seat assembly to prevent further alteration of the orientation of the seat assembly with respect to the carriage and operates the locking mechanism to lock the seat assembly in position at said predetermined angle of inclination and prevent movement of the seat assembly out of said locked position at said predetermined angle of inclination in either of said two directions.

* * * * *